US006588599B2

(12) United States Patent
Gabl et al.

(10) Patent No.: US 6,588,599 B2
(45) Date of Patent: Jul. 8, 2003

(54) SCREEN FOR PULP PROCESSING

(75) Inventors: Helmuth Gabl, Graz (AT); Axel Pichler, Graz (AT); Alexander Gscheider, Hohentauern (AT)

(73) Assignee: Andritz AG, Graz (AU)

( * ) Notice: Subject to any disclaimer, the term of this patent is extended or adjusted under 35 U.S.C. 154(b) by 0 days.

(21) Appl. No.: 09/825,504

(22) Filed: Apr. 3, 2001

(65) Prior Publication Data

US 2001/0045379 A1 Nov. 29, 2001

(30) Foreign Application Priority Data

Apr. 3, 2000 (AT) ..... 552/2000

(51) Int. Cl.[7] ..... B07B 1/04; D21D 5/06

(52) U.S. Cl. ..... 209/273; 209/306; 162/55; 210/413

(58) Field of Search ..... 209/270, 273, 209/281, 283, 300, 305, 306; 210/413, 414, 415; 162/55

(56) References Cited

U.S. PATENT DOCUMENTS

| | | | | |
|---|---|---|---|---|
| 4,832,832 A | | 5/1989 | Fujiwara et al. | 209/273 |
| 5,232,552 A | | 8/1993 | Lundberg et al. | 162/55 |
| 5,497,886 A | | 3/1996 | Young et al. | 209/270 |
| 5,547,083 A | * | 8/1996 | Alajaaski et al. | 209/273 |
| 6,029,821 A | | 2/2000 | Einöder | 209/306 |
| 6,193,073 B1 | * | 2/2001 | Chupka et al. | 209/306 X |
| 6,206,204 B1 | * | 3/2001 | Aikawa | 210/414 |

FOREIGN PATENT DOCUMENTS

| | | | |
|---|---|---|---|
| EP | 0 332 123 B1 | 9/1989 | |
| EP | 0 887 459 A1 | 12/1998 | |
| WO | 92/11410 * | 7/1992 | 209/273 |

OTHER PUBLICATIONS

EPO Search Report EP 1 143 065 A3, dated Oct. 26, 2001.

* cited by examiner

*Primary Examiner*—Tuan N. Nguyen
(74) *Attorney, Agent, or Firm*—Alix, Yale & Ristas, LLP

(57) ABSTRACT

A screen, for screening material used in the production of paper, board and the like, having a screen basket and a rotor supporting several blades which can be moved along the wall of the screen basket when the rotor rotates. The blades having a convex curvature on the side facing the screen basket. The radial clearance between the surface of the blade facing the screen and the screen being lowest between the front sector, viewed in the direction of rotation, and increasing towards the rear edge of the blade.

37 Claims, 4 Drawing Sheets

SCREEN FOR PULP PROCESSING

BACKGROUND OF THE INVENTION

This invention relates generally to screens for separating undesirable material from desirable material. More particularly, the present invention relates to screens for screening material used in the production of paper, board, and the like. Such screens are known in various designs and used world-wide in the paper industry.

Screens are known where blades mounted on a rotor have a cross-section shaped, in direction of rotation, similar to the wing of an aircraft and which begins with a bulb-like curve in the direction of rotation, then converges towards the rear and ends in the shape of a narrow droplet. These blades extend in the form of bars and are the same length as the rotor or screen basket. Normally a cylindrical rotor is provided. In the screens known, the surface of the blade facing the screen basket provided for the pulp particle suspension to pass through is curved such that the radial clearance between the function-bearing blade surface and the screen basket surface facing it is reduced first of all to a minimum in the leading sector of the blade. After a brief stretch where the minimum clearance to the facing screen basket surface remains approximately the same, the radial clearance then rises again towards the rear end or rear edge of the blade. The purpose of this is to squeeze the screening material suspension through the openings in the screen basket, assisted by dynamic pressure, in the leading front area of the blade with diminishing clearance to the screen basket. In the rear trailing sector of the blade, whose clearance to the screen basket surface facing it gradually increases, a kind of suction effect is generated on the suspension material already pushed through to the other side of the screen basket in order to achieve a backwashing and rinsing off action of the impurities on the screen basket. This suction effect is known and experts shared the opinion hitherto that blades with a cross-section similar to a narrow, curved droplet have the optimum shape for effectiveness of the rotor and the blades to achieve a substantial backwashing effect and obtain the lowest possible flow resistance as the blade moves through the fibre pulp.

In the present description of the state of the art, it should be added that there are two basic types of screen: There are screens with a screen basket which is fed suspension to be screened from the inside and which have blades inside the screen basket, known as "centrifugal screens", and there are screens with blades rotating outside the screen basket and brushing over it on the outside with low clearance, where these so-called "centripetal screens" feed the material to be screened to the screen basket from the outside and the cleaned pulp suspension is carried off the inside of the screen basket.

In centripetal screens with screen basket on the inside and blades rotating on the outside of it, the rotating shank of the rotor has a star or disc-shaped support in the inlet or top section of the screen basket, overlapping outwards over this screen basket, and with extensions protruding downwards to which the blades rotating round the screen basket are secured.

SUMMARY OF THE INVENTION

The present invention is now based on the observation that the hitherto conventional airfoil shape of the blade surface closer to the screen basket, particularly the planned reduction in clearance between blade and screen basket in the leading sector of the blade is not the optimum design, neither in terms of fluid mechanics and energy efficiency, nor with regard to efficiency of the separation process, flow rates and separation performance.

It was discovered unexpectedly that a substantial improvement can be achieved in the operating results and quality of the cleaned material by modifying the clearance between the surface of the individual blades facing the screen basket and the screen basket surface facing each blade, and by selecting a special shape of blade cross-section.

Thus, the subject of the invention is a screen as described above, where the radial clearance between the leading sector of the blade, viewed in the direction of rotation, particularly the front end or the front edge of the surface of the blade facing the screen basket, and the surface of the screen basket is a minimum clearance and rises to a maximum clearance towards the rearmost sector, or the rear edge, of the blade.

The arrangement of the individual blades according to the invention and the continuous widening in clearance between the screen basket and the surface of the blades succeed in avoiding any pressure build-up. It has been demonstrated that the pressure exerted on the suspension to be screened in order to transport it through the screen is more than adequate to push sufficiently large quantities of pulp suspension through the openings in the screen basket and that no additional increase in pressure by special shaping of the rotor blade leading sector with diminishing clearance to the screen basket surface is required to implement this procedure effectively.

On the contrary, the increased suction effect now applied by the entire blade as a result of the widening clearance to the suction basket surface further back on the blade creates much more effective backwashing and, as a result, better removal of the particles and impurities separated from the screening material from the walls of the screen basket. The blades arranged and shaped according to the invention exert lower pressure or "underpressure" in the pulp suspension over their entire length and span in the direction of rotation, i.e. over the entire surface, compared to the pressure they otherwise apply in the screen casing. As a result, the inverse suction effect on a portion of the pulp suspension that has already passed through the openings in the screen basket is increased and backwashing occurs through the openings in the screen basket. Due to improved removal of the impurities retained, the separation behavior and performance of the screen according to the invention is enhanced. Due to the offset arrangement of the blades there is practically always vorticity at every point of the screen basket, which has the effect of cleaning the screen surface. The liquid flow from the feed may also be influenced favorably with a rotor shaped as a paraboloid of revolution.

The principal advantages of the screen and blades according to the invention are as follows:

- Lower energy consumption as a result of the lower pressure build-up in the leading sector of the blade and thus, less flow resistance.
- Lower pulsation generated by positioning the narrowest flow cross-section between blade and screw basket walls directly at or in the vicinity of the blade front edge.
- Higher turbulence generated at the edges of the individual blades and thus, improved screen exposure for higher throughput and separation performance.
- Low pressure shocks towards the screen surface and the area behind it, thus significant improvement in screening quality.

Lower rotor speed at constant throughput and thus, lower energy requirement.

The front or leading sector of the blade forms virtually no or only a small angle with the screen basket surface with minimum clearance to the blade. In those areas where the invention dictates a small angle, this configuration allows a high backwashing rate and the stronger suction effect ensures more effective removal of particle material from the screen basket surface.

The curvature of the blade surface facing the screen basket is important for the desired backwashing and for the suction effect. It has been shown that improved backwashing can be obtained with different curvature at the front and rear sectors, viewed in the direction of rotation, of the individual blades. That is, when the surface of the blades facing the screen basket are more curved in the leading sector than in the trailing sector. Preferably the curvature of the surface of the blade is greater at the front sector by some 5 to 20%, especially by 10 to 15%, than the curvature of the surface of the screen basket and the curvature of the surface of the blade is greater in its trailing sector by some 0 to 9%, preferably by 0 to 4%, than the curvature of the surface of the screen basket, and where preferably the transition zone from the preferably circular cylindrical curvature of the leading sector of the blade to the preferably circular cylindrical curvature of the trailing sector extends over the middle third of the length of the blade, where the transition from the strongly curved, leading sector to the less curved trailing sector takes place steadily. Such design boosts the effectiveness when separating the pulp suspension from the impurity particles.

The choice of different curvatures for the various sectors of the blade surface facing the screen basket allows the blade surface to be adapted effectively to cope with different operating conditions and material compositions. Maintaining a ratio of 0.05 to 0.5, preferably 0.1 to 0.3, between the minimum clearance and the maximum clearance between the surface of a blade and the screen basket also provides an advantage in this connection.

In detailed investigations aimed at optimizing the cross-sectional shape of the rotor blade it was established that the conventional configuration used hitherto with airfoil-shaped cross-section, which is both expensive and relatively complicated to implement technically, is not only unnecessary, but can even hamper effectiveness. Blades of a plate-type design, preferably with the same material thickness from the front edge or tip to the rear edge, provide a simpler and effective blade design which can be manufactured at reasonable cost. The lower centrifugal forces resulting from the plate-type blade cross-section—avoiding an airfoil shape—permit a cost-saving, light-weight design, virtually for the first time, and these can also be used with lighter-weight blade holding devices. Advantageously, the blades will have a thickness of 2 to 8 mm, particularly 5 to 6 mm, where preferably the blades are made of curved sheet metal, particularly, with their inner and outer surfaces parallel to one another.

In addition it was found that certain design details are capable of further enhancing the advantageous effects of the present invention. This is true, for example, of the shaping of the front edge of the rotor blade, viewed in direction of rotation, as a narrow rectangle, where the two front, corner edges can be rounded off it necessary.

Various different contours have proved favorable for the shape or form of the blade. For example, the contour of the blades may be narrower in a horizontal projection in their leading front sector than in their rear trailing sector or at the rear edge. The blades may have largely, triangular, deltoid, trapezoidal or dovetailed contours in a horizontal projection. The side edges of the blade may extend in a straight line from a front tip or narrow front edge and diverging at an angle towards the rear, forming an angle of 40 to 120°, preferably between 60 and 90°. If the contour is shaped in steps, these steps or indentations need not be located in a straight line by any means, but may describe a concave or convex curve. For the purposes of the invention, the blade contour widening from the front end towards the rear can have edges converging at an angle again in its rearmost third. The blade contour shapes described also contribute towards reducing the flow resistance when the blades move through the pulp suspension.

Furthermore it was established that the suction effect can be further increased if measures are implemented to ensure that the blade surfaces contain strip-like elevations extending at right angles to the direction of rotation of the rotor and on the far side of which an increased suction effect is generated locally in each case in contrast to the conventional suction effect of the blade surface.

The rotor itself can be formed in one piece. It can be expedient to use a design where several individual rotor modules are put together to form a rotor with any desired axial span. The rotor may have several blade supports, for example web plates, extending outwards from its shaft or the rotor body, mounted with uniform clearance to one another. Such features permit a highly robust construction in operation and also mechanical stability.

Additionally the invention includes a blade shaped as a bent or curved plate, preferably with the same material thickness from the front edge or tip to the rear edge. With conventional blades it was considered a disadvantage that these components were solid and heavy structures, particularly because these blades had an airfoil-shaped cross-section. With a blade design of the inventive type it is possible to manufacture a lightweight blade and lend the blades the desired shape by simple means, as well as to adapt the blades to suit different applications.

To facilitate changing the blade, particularly in order to insert blades that have been adapted to suit different rotor speeds or pulp suspensions, the blade may have a base section attached to its inner surface, on which fastening devices are provided. Alternatively, the blade may have screw holes for screwing it to a support.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
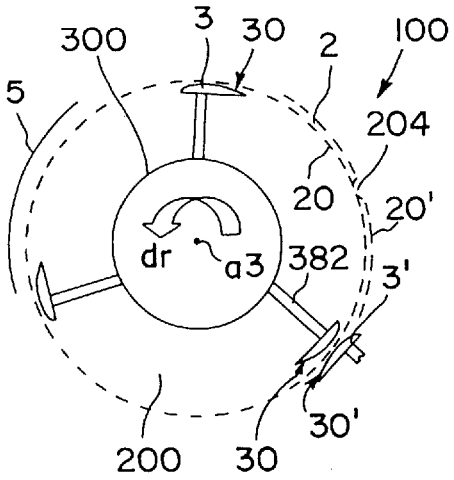
FIG. 1 PRIOR ART
FIG. 1 is a schematic sectional view of a first type of conventional screen.
Figure 2:
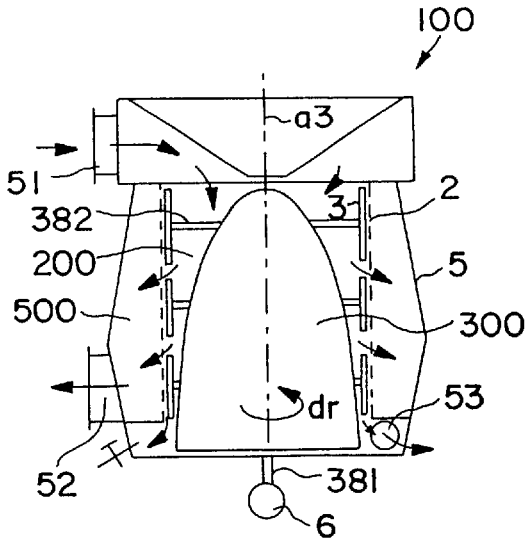
FIG. 2 PRIOR ART
FIG. 2 is a cross-sectional view of the screen of FIG. 1.

The screen 100 shown schematically in a horizontal and a vertical sectional view in FIGS. 1 and 2 has a casing 5 with an inlet 51 for a screening material suspension, with an outlet 52 for accept pulp that has been freed of impurities. At the base of the casing 5 there is an outlet 53 or similar for discharging the impurities separated from the screening material. In the inner chamber 500 of the roughly barrel-shaped or cylindrical casing 5 there is a concentrically mounted, cylindrical screen basket 2 with round or slot-type screening openings 204 for the clean pulp suspension to pass through. In the inner chamber 200 of the screen basket 2 there is a rotor 300 and mounted on a pivoting bearing on a shaft 381 driven by a motor 6 through a vertical axis of rotation a3. Web plates 382 extend from the rotor 300, particularly in radial direction, and each carry a blade 3 which can be moved past the inner surface 20 of the screen basket 2 at the end of the web plate 382 closest to the screen basket 2. The screening material that is fed in through the inlet 51 under pressure, enters the screen basket's 2 inner chamber 200, whose cross-section in this case becomes more and more constricted concentrically in the downward direction because of the paraboloid shape of the rotor 300. The accept pulp, comprising fibrillated material free of impurities, is pushed by the action of the pressure introduced into the pulp suspension through the openings 204 in the screen basket 2 outwards into the inner chamber 500 of the casing 5 that surrounds the screen basket 2 and from where the suspension is discharged through the outlet 52. The openings 204 in the screen basket 2 are dimensioned such that the impurity particles in the screening material suspension, such as glass splinters, coarser sand grains, small stones, metal particles, and similar, are retained in the screen basket 2, particularly that they adhere to its inner surface 20 at the screening openings 204. Without appropriate counter-measures the openings 204 would clog up and fibrillated accept suspension free of impurities would be prevented from passing through them. To prevent this from happening, the cross section of the known blades 3 is shaped like an aircraft wing and the trailing sector 33—viewed in the direction of rotation dr—of their outer surface 30 exerts suction on the suspension as a result of its increasing clearance from the inner surface 20 of the screen basket 2. This results in a small part of the accept suspension filtered immediately beforehand through the screen basket or pushed out of the screen basket, respectively, being washed back into the screen basket 2. Due to this backwashing effect the impurities clogging the openings 204 are detached from the inner surface 20 of the screen basket 2, fall to the floor of the screen basket 2 and eventually reach the outlet 53.

Figure 3:
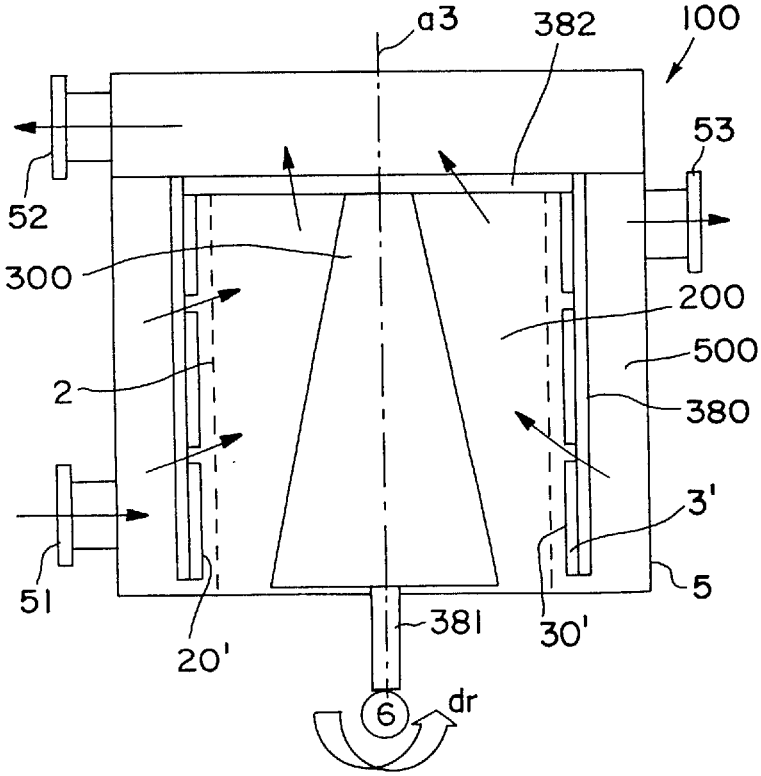
FIG. 3 PRIOR ART
FIG. 3 is a cross-sectional view of a second type of conventional screen.

The screen 100 shown in FIG. 3 works according to an operating principle that is inverse to that of the screen 100 shown in FIGS. 1 and 2. The casing 5 has an inlet 51 at the bottom for the pulp suspension to be screened, an outlet 52 at the top for the pulp suspension after it has been freed from impurities, and also a relatively high outlet 53 for impurities. In the casing 5 a rotor 300 with a conical cross-section is mounted that can be rotated round the axis a3 with a motor 6. The top end of the rotor 300 supports a support disc or arms/web plates 382 extending radially in a star shape. Extending from the support disc or arms 382 there are blade supports 380 pointing downwards which hold the inwardly projecting blades 3'. The inner surfaces 30' of the blades 3' rotate round the screen basket 2 or rather round its outer surface 20' with relatively little clearance. The separation of accept and impurities takes place in the same way as described in connection with FIGS. 1 and 2. The screen 100 illustrated in FIG. 3 and with the design known also has blades 3' which are largely airfoil-shaped and display the disadvantages discussed above of higher energy consumption and lack of optimum backwashing effect, leading to less effective cleaning of the screen basket 2 and unplugging of the openings 204.

Figure 4:
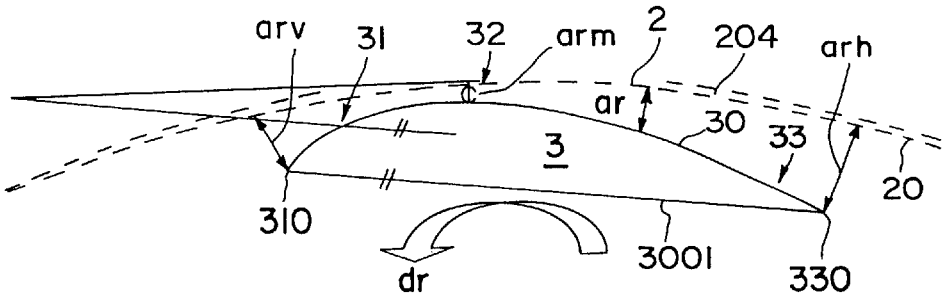
FIG. 4 PRIOR ART
FIG. 4 is an enlarged view of the blade and basket of FIG. 1.

The schematic drawing in FIG. 4 shows part of the screen basket 2 with its screening openings 204 for the accept suspension. The radial clearance ar between the surface 30 of the blade 3 facing the screen basket and the inner surface 20 of the screen basket 2 varies along the length of the blade 3. The blade 3 with airfoil-shaped cross-section has relatively large radial clearance arv at its leading edge 310 and/or in the foremost, initial sector 31. Between this initial sector 31 of the blade 3 and a relatively narrow middle zone 32 the radial clearance ar decreases to a minimum arm. From this zone 32 the radial clearance ar increases towards the rear sector 33 and trailing edge 330 up to a maximum value arh. At the front edge 310 and along the front sector 31 there is a pressure build-up extending to the middle zone 32 when the blade 3 is moved in the direction of rotation dr. Only in the trailing section 33 where the clearance between surface 30 and surface 20 of the screen basket 2 increases is an important suction effect generated for backwashing of the impurities. The blade 3 has a flat inner surface 3001.

Detailed investigations have shown that an airfoil is not the optimum shape for the blade 3 in terms of the energy required to rotate the rotor 300, the effectiveness of backwashing, and clearing of any impurities from the screening openings 204. Since it is state of the art for the blade 3 with airfoil-shaped cross-section to have a front section 31—viewed in the direction of rotation dr—where the clearance ar diminishes approximately as far as the sector where the web plate 382 is attached (FIG. 1), there is a dynamic pressure counter-effect in the pulp suspension which hampers rotation, thus increasing the energy consumption for rotation. Furthermore, only part of the entire blade surface 30, to be precise the trailing sector 33, is available for backwashing to clean the screen basket openings 204.

Figure 5:
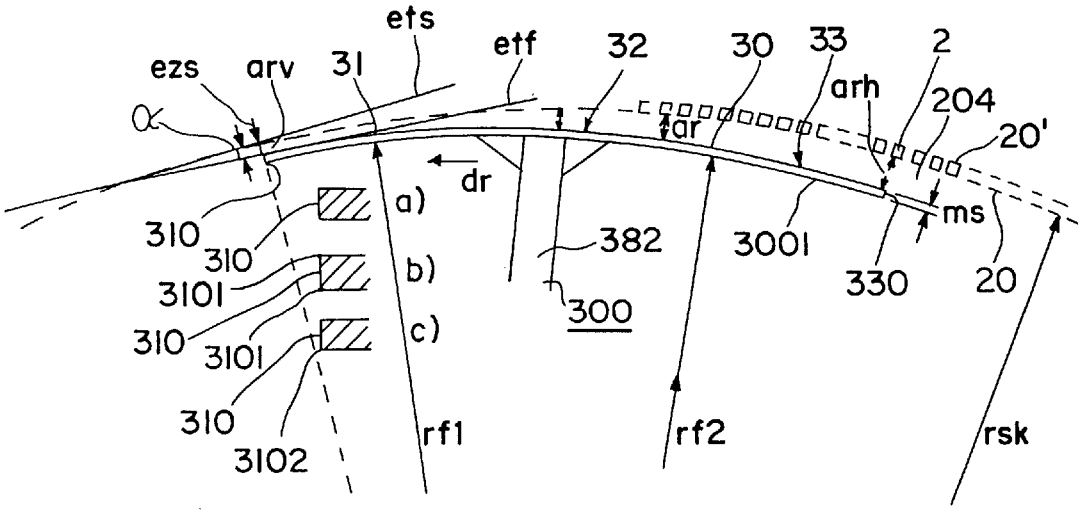
FIG. 5 is a schematic sectional view of a blade, web plate, and basket in accordance with a first embodiment of the invention.

The blade 3 shown in the sectional view in FIG. 5, mounted and designed according to the invention, has a convex outer surface 30 facing the cylinder jacket-shaped surface 20 of the screen basket 2. The blade 3 is of plate-type design, e.g. made from sheet metal or synthetic material of even thickness ms. It is an advantage if the inner surface 3001 runs parallel to the outer surface 30, that is to say these two surfaces 30 and 3001 have the same curvature.

In practice the blade 3 is some 5 to 6 mm thick, the screen basket 2 is usually 400 to 3000 mm in diameter and some 500 to 1500 mm high.

The small auxiliary sketches pertaining to FIG. 5 provide three examples of the preferred shape of front edge 310 of the blade 3, where the face end has a rectangular cross-section in a), a similar cross-section shape with rounded edges in b) 3101, and is rounded off 3102 in sketch c).

The blade 3 according to the invention, which differs substantially from state-of-the-art blades, is mounted in relation to the facing surface 20 of the screen basket 2 such that the clearance between the surface 30 of the blade 3 and the surface 20 gradually increases from the blade's leading edge 310 towards its trailing edge 330 and the radial clearance ar increases from the front to the rear. The smallest radial clearance arv is found at the leading edge 310, and the largest clearance arh is at the trailing edge 330.

According to FIG. 5, the curvature radius rsk of the surface 20 of the screen basket 2 is greater than each of the two curvature radii rf1 and rf2 of the leading sector 31 and the trailing sector 33 of the surface 30 of the blade 3. It is an advantage that the surface 30 runs virtually parallel to surface 20 in the vicinity of the front edge 310. A tangent plane etf drawn at the front sector 31 in the direct vicinity of the front edge 310 forms an acute angle of a few degrees with the corresponding radial tangential plane ets drawn at the surface 20. This acute angle is determined by the radius rf1 of the curvature at the front edge 310.

The radial clearance ar of the surface 30 rises from the minimum clearance arv continuously to a maximum clearance arh and, due to this "pitch" of the blade 3 in relation to the direction of rotation dr and compared with the screen basket 2, the suction effect that comes to bear during backwashing when the blade 3 moves in relation to the screen basket 2 is guaranteed over the entire span of the blade in the direction of rotation dr.

According to a special design shape, the radius rf1 of the curvature of the front sector 31 of the surface 30 can be smaller than the radius rf2 of the curvature in the trailing sector 33, with a transition area being provided in the intermediate zone 32 between the two different curvatures. It is not desirable to have an edge approximately following the path of a generator of the surface 30 between the strongly curved leading sector 31 and the less curved trailing sector 33 of the surface 30.

The modification described to the degree of curvature over the span of the blade 3 yields advantageous changes to the flow conditions and leads to favorable changes in pressure in the suspension. The curvatures should preferably have a circular cylindrical shape, but can also be oval or elliptical.

It is a particular advantage if the tangential plane etf drawn at the leading sector 31 of the surface 30, 30' facing the screen basket or at the area around the tip of the front edge 310 of the blade 3, 3' forms an angle of 0 to 15°, preferably between 0 and 8°, particularly between 0 and 2°, with the tangential plane ets drawn at a corresponding radial generator ezs of the surface 20, 20' of the screen basket 2 facing the blade 3, 3'. As a result, the surface 30 obtained has more favorable fluid mechanics properties and the suction effect is improved. This sizing applies for blades 3, 3' rotating both inside and/or outside the screen basket 2.

It can be an advantage if the curvature at the front or leading sector 31 of the surface 30 of the blade 3 adjacent to the screen basket is 5 to 20%, preferably 10 to 15%, larger than the curvature of the facing surface 20 of the screen basket 2 and if the curvature at the rear or trailing sector 33 of the surface 30 of the blade 3 is between 0 and 9%, preferably between 0 and 4%, larger than the curvature of the surface 30 of the screen basket 2.

Figure 6:
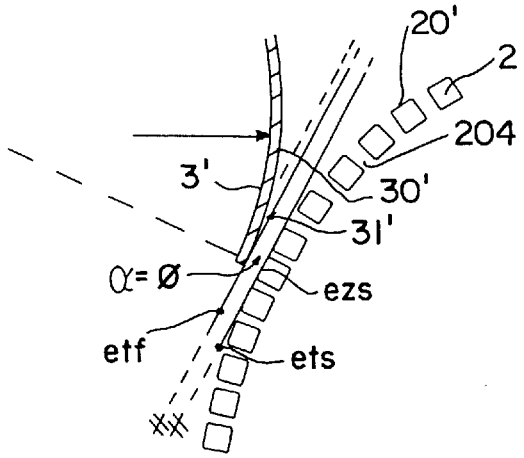
FIG. 6 is a schematic sectional view of a blade and basket in accordance with a second embodiment of the invention.
Figure 12:
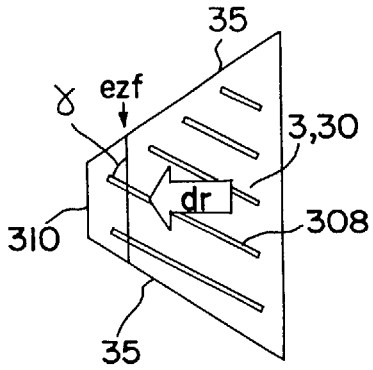
FIG. 12 is a horizontal projection of a second blade in accordance with the invention.

FIG. 6 shows a schematic view of the screen basket 2 of a centripetal screen with blades 3' rotating around the outside of the screen basket 2, with surfaces 30' which have less curvature than the outer surface 20 of the screen basket 2 and whose convex surface 30' faces the outer surface 20' of the screen basket 2. The broken line indicates that the curvature of the blade 3' can possibly also be "infinite" in the front sector 31', i.e. that the angle at the front edge 310 could be equal to the limiting value 0°.

Figure 7:
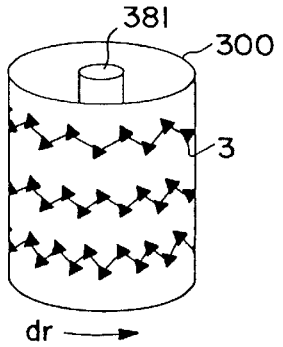
FIG. 7 is schematic view of a first blade arrangement in accordance with the invention.
Figure 8:
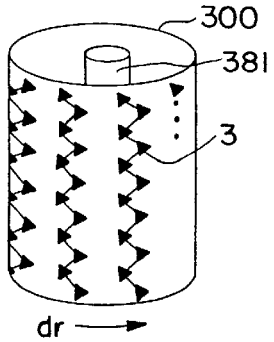
FIG. 8 is schematic view of a second blade arrangement in accordance with the invention.
Figure 9:
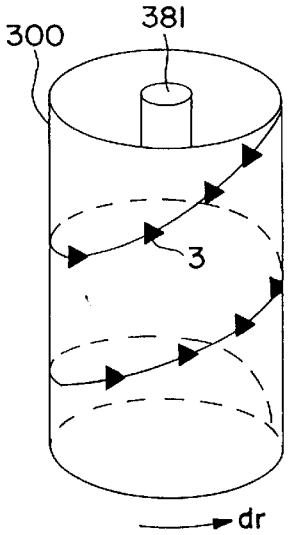
FIG. 9 is schematic view of a third blade arrangement in accordance with the invention.
Figure 10:
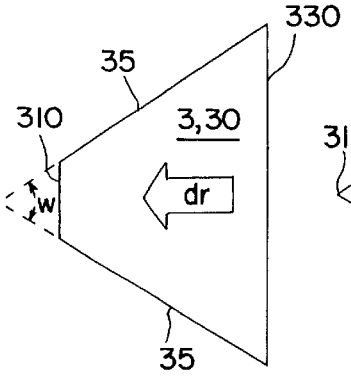
FIG. 10 is a horizontal projection of a first blade in accordance with the invention.
Figure 11:
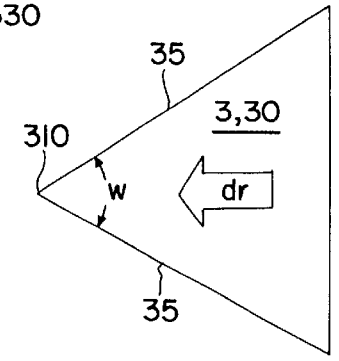
FIG. 11 is a horizontal projection of a first blade in accordance with the invention.

FIG. 7 shows a rotor 300 with blades 3 offset in relation to each other in height, in a zigzag arrangement, and designed according to the invention. By contrast, FIG. 8 shows a rotor 300 with blades 3 offset in relation to each other round the circumference. FIG. 9 shows a rotor 300 fitted according to the invention with blades 3 arranged along an ascending spiral line.

FIGS. 10 to 16 show blades 3, 3' according to the invention with trapezoidal, triangular and basically trapezoidal overall contours, shown in the order of listing. On its surface 30 the blade 3 according to FIG. 12 has turbulence bumps 308 in strip form, arranged at angle $\gamma$ to the blade generator ezf, where $\gamma$ is preferably between 10 and 45°, particularly between 15 and 30°, in this case approximately parallel to the lower side edge 35, to form a corrugated surface. Groove-shaped indentations can also be formed in the blade 3 instead of these bumps 308.

The angle $\omega$ formed by the diverging side edges 35 against the direction of rotation dr measures between 20 and 60°, preferably 25 to 50°. The approximately strip-shaped bumps 308 or the indentations on the surface 30 of a blade 3 cause local underpressure turbulence when the blade 3 moves and this assists in detaching the impurity particles adhering to the screen basket 2.

Figure 13:
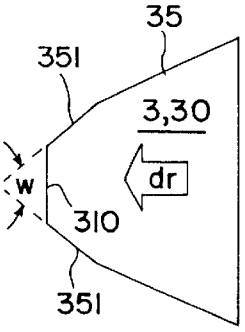
FIG. 13 is a horizontal projection of a third blade in accordance with the invention.
Figure 14:
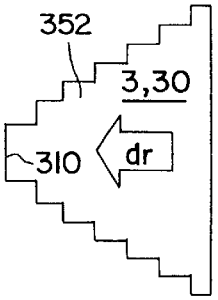
FIG. 14 is a horizontal projection of a fourth blade in accordance with the invention.

At the blade 3 in FIG. 13 the side edges 35 are convex with an obtuse angle and the sections 351 directly adjoining the short, front edge 310 together form the angle $\omega$. The side edges 35 of the blade 3 in FIG. 14 are designed with even steps 352. The graduated side edge 35 substantially increases its overall length and thus enhances the turbulence in the pulp suspension when the blade 3 rotates.

Figure 15:
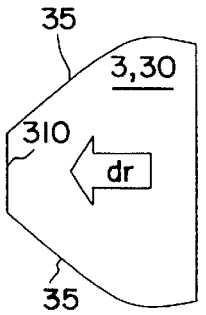
FIG. 15 is a horizontal projection of a fifth blade in accordance with the invention.
Figure 16:
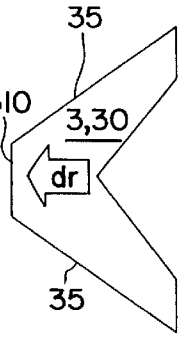
FIG. 16 is a horizontal projection of a sixth blade in accordance with the invention.

The contour shape of the blade 3 in FIG. 15 has diverging side edges 35 in its front sector which then begin to deflect inwards approximately in the rearmost third of the surface 30, then run towards each other in two short branches to the rear at an angle and terminate at the rear edge 330. The blade 3 shown in FIG. 16 has a dovetailed contour with a short front edge 310.

Figure 17:
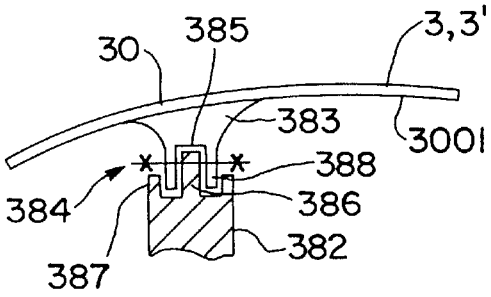
FIG. 17 is an enlarged schematic sectional view of a blade and web plate in accordance with the invention illustrating a first apparatus for fastening the blade to the web plate.
Figure 18:
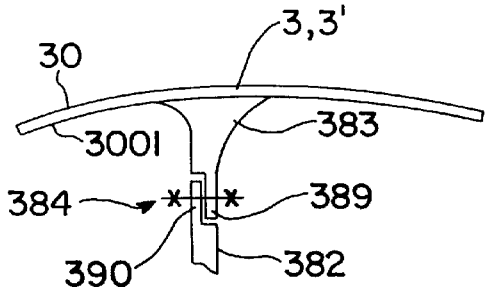
FIG. 18 is an enlarged schematic sectional view of a blade and web plate in accordance with the invention illustrating a second apparatus for fastening the blade to the web plate.
Figure 19:
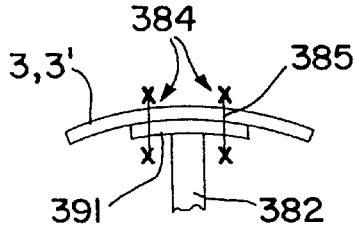
FIG. 19 is an enlarged schematic sectional view of a blade and web plate in accordance with the invention illustrating a third apparatus for fastening the blade to the web plate.

FIGS. 17, 18, and 19 show diagrams of blades 3, 3' which can be connected in various ways by means of arms, web plates 382 or supports 384 extending out from the rotor 300. The blades 3, 3' are made of curved sheet metal, particularly with a parallel outer surface 30 and inner surface 3001. According to FIGS. 17 and 18, a base section 383 is shaped onto the blades 3, 3'. The base section 383 in FIG. 17 has an internal, sleeve-shaped recess 385, into which the prolongation 386 of the support 382 is inserted. Lateral projections 387 enclose the side limitations 388 of the recess 385. The projection 386 and the recess 385 are connected by a screw—as intimated.

In the blade 3, 3' design shown in FIG. 18, the final sector of the base section 383 has a projection 389 which interacts with a projection 390 in the web plate 382. The projections 389 and 390 are screwed together—as intimated at 384.

According to FIG. 19, the blade 3, 3' can be screwed to a supporting member 391 secured to the support or web plate 382 using the screws intimated at 384.

The designs illustrated allow easy replacement of the blades 3, 3' so that a screen fitted with this type of blade can be adapted quickly to handle different operating conditions.

What is claimed is:

1. A blade for use with screens for screening material, the screen having a receiving surface for receiving unscreened material and defining a plurality of openings for passage of the screened material, the blade comprising an arcuate, plate-shaped body including oppositely disposed biasing and inner surfaces, oppositely disposed leading and trailing edges, a leading sector extending from the leading edge and a trailing sector extending from the trailing edge, the biasing and inner surfaces defining a thickness, the thickness of the body being substantially uniform from the leading edge to the trailing edge, the curvature of the biasing surface of the leading sector being greater than the curvature of the biasing surface of the trailing sector, the biasing surface having a convex curvature and being adapted for biasing material through the openings of the screen.

2. Blade according to claim 1 wherein the thickness is in the range of 2 to 8 mm.

3. Blade according to claim 1 wherein the thickness is in the range of 5 and 6 mm.

4. Blade according to claim 1 wherein the receiving and inner surfaces are substantially parallel to each other.

5. Blade according to claim 1 further comprising a transition sector disposed intermediate the leading and trailing sectors, the curvature of the biasing surface of the leading sector being reduced to the curvature of the biasing surface of the trailing sector over the transition sector.

6. Blade according to claim 1 wherein the leading edge has a rectangular shape.

7. Blade according to claim 1 also comprising oppositely disposed side edges defining a width, the width of the blade at the leading edge being narrower than the width of the blade at the trailing edge.

8. Blade according to claim 7 wherein the blade has a triangular, deltoid, trapezoidal, or dovetail shape.

9. Blade according to claim 7 wherein each side edge has a shape selected from the group consisting of straight-line, curved line, convex, concave, and stepped.

10. Blade according to claim 7 wherein the side edges define an angle of 40 to 120°.

11. Blade according to claim 7 wherein the side edges define an angle of 60 and 90°.

12. Blade according to claim 1 wherein the biasing surface has a plurality of spaced corrugations extending at an acute angle to a generator of the biasing surface.

13. Blade according to claim 12 wherein the corrugations define an angle between 10 and 45° with the generator of the biasing surface.

14. Blade according to claim 12 wherein the corrugations define an angle between 15 and 30° with the generator of the biasing surface.

15. Blade according to claim 1 also comprising a base section extending from the inner surface, the base section being adapted for mounting the blade to a rotor of the screen.

16. Blade according to claim 15 wherein the base section defines an opening adapted for receiving a mounting screw.

17. Screen for screening material comprising:

a substantially cylindrical screen basket having a receiving surface for receiving unscreened material, the screen basket defining a plurality of openings;

a rotor rotatable about an axis in a direction of rotation; and a plurality of blades supported on the rotor and rotatable therewith, each blade being disposed adjacent the screen basket and extending in the direction of rotation from a trailing edge to a leading edge, each blade including a leading sector extending from the leading edge, a trailing sector extending from the trailing edge, and a biasing surface having a convex curvature facing the receiving surface of the screen basket, the curvature of the biasing surface of the leading sector being greater than the curvature of the biasing surface of the trailing sector, the biasing surface of the blade and the receiving surface of the screen basket defining a radial clearance therebetween, the radial clearance increasing from a minimum value substantially adjacent the leading edge of the blade to maximum value substantially adjacent the trailing edge of the blade.

18. Screen according to claim 17, wherein a first tangential plane extending from the biasing surface at a position substantially adjacent the leading edge of the blade and a second tangential plane extending from the receiving surface at a position substantially opposite the leading edge of the blade define an angle of 0 to 15°.

19. Screen according to claim 17, wherein a first tangential plane extending from the biasing surface at a position substantially adjacent the leading edge of the blade and a second tangential plane extending from the receiving surface at a position substantially opposite the leading edge of the blade define an angle of 0 and 8°.

20. Screen according to claim 17, wherein a first tangential plane extending from the biasing surface at a position substantially adjacent the leading edge of the blade and a second tangential plane extending from the receiving surface at a position substantially opposite the leading edge of the blade define an angle of 0 and 2°.

21. Screen according to claim 17 wherein the screen basket has an inner surface defining the receiving surface and each blade is disposed within the screen basket adjacent the inner surface, the curvature of the biasing surface of each blade being greater than the curvature of the inner surface of the screen basket.

22. Screen according to claim 17 wherein the screen basket has an outer surface defining the receiving surface and each blade is disposed outside of the screen basket adjacent the outer surface, the curvature of the biasing surface of each blade being less than the curvature of the outer surface of the screen basket.

23. Screen according to claim 17 wherein each blade is plate-shaped, having a substantially uniform thickness from the leading edge to the trailing edge.

24. Screen according to claim 17 wherein the curvature of the biasing surface of the leading sector of the blade is 5 to 20% greater than the curvature of the receiving surface of the screen basket and the curvature of the biasing surface of the trailing sector is 0 to 9% greater than the curvature of the receiving surface of the screen basket.

25. Screen according to claim 17 wherein the curvature of the biasing surface of the leading sector of the blade is 10 to 15% greater than the curvature of the receiving surface of the screen basket and the curvature of the biasing surface of the trailing sector is 0 to 4% greater than the curvature of the receiving surface of the screen basket.

26. Screen according to claim 17 wherein each blade also has a transition sector disposed intermediate the leading and trailing sectors, the curvature of the biasing surface of the leading sector being reduced to the curvature of the biasing surface of the trailing sector over the transition sector.

27. Screen according to claim 17 wherein the biasing surface of each blade has a generator which is substantially parallel to the axis of the rotor.

28. Screen according to claim 17 wherein the biasing surface of at least some of the blades is a corrugated surface having a plurality of spaced corrugations extending at an acute angle to a generator of the biasing surface.

29. Screen according claim 17 wherein the blades are arranged on the rotor in the shape of an ascending spiral line when viewed in the direction of rotation.

30. Screen according claim 17 wherein the blades define longitudinally spaced rows of blades.

31. Screen according claim 30 wherein the blades in each row of blades are longitudinally offset from each other, whereby the blades in each row of blades define a zig-zag row.

32. Screen according claim 17 wherein the blades define circumferentially spaced rows of blades.

33. Screen according claim 32 wherein the blades in each row of blades are circumferentially offset from each other, whereby the blades in each row of blades define a zig-zag row.

34. Screen according to claim 17 wherein the rotor comprises a plurality of rotor modules.

35. Screen according to claim 17 wherein the rotor includes a plurality of radially spaced blade supports.

36. Screen according to claim 17 wherein a ratio of the minimum value of the radial clearance to the maximum value of the radial clearance is in the range of 0.05 to 0.5.

37. Screen according to claim 17 wherein a ratio of the minimum value of the radial clearance to the maximum value of the radial clearance is in the range of 0.1 to 0.3.

* * * * *